US011507012B2

(12) United States Patent
Nakane et al.

(10) Patent No.: US 11,507,012 B2
(45) Date of Patent: Nov. 22, 2022

(54) CLEANING DEVICE AND IMAGE FORMING APPARATUS CAPABLE OF SUPPRESSING UNEVENNESS IN CONTACT PRESSURE OF AN ELASTIC MEMBER

(71) Applicant: Konica Minolta, Inc., Tokyo (JP)

(72) Inventors: Yoshiki Nakane, Hachioji (JP); Ken Nakano, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/659,099

(22) Filed: Apr. 13, 2022

(65) Prior Publication Data

US 2022/0342357 A1 Oct. 27, 2022

(30) Foreign Application Priority Data

Apr. 23, 2021 (JP) ..... JP2021-073187

(51) Int. Cl.
*G03G 21/00* (2006.01)
*G03G 21/16* (2006.01)

(52) U.S. Cl.
CPC ..... *G03G 21/0017* (2013.01); *G03G 21/007* (2013.01); *G03G 21/0011* (2013.01); *G03G 21/169* (2013.01)

(58) Field of Classification Search
CPC ..... G03G 21/0011; G03G 21/0017; G03G 21/0029
USPC ..... 399/350, 351
See application file for complete search history.

(56) References Cited

U.S. PATENT DOCUMENTS 10,795,306 B2 * 10/2020 Nakane et al. .... G03G 21/0011
2010/0300484 A1 * 12/2010 Gumbe et al. ..... G03G 21/0029 399/350

FOREIGN PATENT DOCUMENTS

JP 2008-070585 A 3/2008

* cited by examiner

*Primary Examiner* — William J Royer
(74) *Attorney, Agent, or Firm* — Lucas & Mercanti, LLP

(57) ABSTRACT

A cleaning device includes a cleaner that cleans a body to be cleaned, wherein the cleaner includes: an elastic member in which a contact portion in contact with the body to be cleaned is formed in an uneven shape continuous in a predetermined direction; and a support member that supports the elastic member, and the cleaner is configured so that a contact pressure of the elastic member to the body to be cleaned is constant in the predetermined direction.

14 Claims, 8 Drawing Sheets

FIG. 11

| | CLEANING FAILURE | | WEAR WIDTH (μm) | | | |
|---|---|---|---|---|---|---|
| | INITIAL | DURABILITY | FLAT PART | CONVEX PART | CONCAVE PART | INCLINED PART |
| FIRST EXAMPLE | ◎ | △ | – | 35 | 37 | 33 |
| SECOND EXAMPLE | ◎ | ○ | – | 31 | 32 | 28 |
| THIRD EXAMPLE | ◎ | ○ | – | 26 | 29 | 21 |
| FOURTH EXAMPLE | ◎ | ◎ | – | 21 | 25 | 17 |
| FIFTH EXAMPLE | ◎ | △ | – | 23 | 38 | 16 |
| SIXTH EXAMPLE | ◎ | ◎ | – | 27 | 28 | 22 |
| FIRST COMPARATIVE EXAMPLE | ◎ | × | 48 | – | – | – |
| SECOND COMPARATIVE EXAMPLE | △ | × | – | 52 | 58 | 36 |

FIG. 12

| | PRESENCE OR ABSENCE OF OCCURRENCE OF CURLING | NUMBER OF OCCURRENCE OF CURLING |
|---|---|---|
| SEVENTH EXAMPLE | × | 221 |
| EIGHTH EXAMPLE | ○ | 0 |

CLEANING DEVICE AND IMAGE FORMING APPARATUS CAPABLE OF SUPPRESSING UNEVENNESS IN CONTACT PRESSURE OF AN ELASTIC MEMBER

The entire disclosure of Japanese patent Application No. 2021-073187, filed on Apr. 23, 2021, is incorporated herein by reference in its entirety.

BACKGROUND

Technological Field

The present invention relates to a cleaning device and an image forming apparatus.

Description of the Related Art

Conventionally, in an image forming apparatus, a cleaner for cleaning a body to be cleaned such as an image carrier is provided. Since such a cleaner cleans a body to be cleaned by sliding with respect to the body to be cleaned, the cleaner wears, and thus, it is necessary to replace a component related to the cleaner. In the image forming apparatus, there is a need to reduce the downtime of the image forming apparatus by lengthening a replacement cycle of the component, and thus, it is important to reduce the wear of the component related to the cleaner.

For example, Japanese Patent Application Laid-Open No. 2008-070585 discloses a device in which a contact portion of an elastic member supported by a plate-shaped support member with respect to a body to be cleaned is formed in a corrugated shape continuous in a longitudinal direction.

However, in the configuration described in Japanese Patent Application Laid-Open No. 2008-070585, since contact pressure with respect to the body to be cleaned is different between a convex portion and a concave portion of the corrugated shape, unevenness of the contact pressure of the elastic member may occur in the entire longitudinal direction (predetermined direction), and eventually, cleaning failure may occur.

SUMMARY

An object of the present invention is to provide a cleaning device and an image forming apparatus capable of suppressing occurrence of unevenness in contact pressure of an elastic member in an entire predetermined direction.

To achieve the abovementioned object, according to an aspect of the present invention, a cleaning device reflecting one aspect of the present invention comprises a cleaner that cleans a body to be cleaned, wherein the cleaner includes: an elastic member in which a contact portion in contact with the body to be cleaned is formed in an uneven shape continuous in a predetermined direction; and a support member that supports the elastic member, and the cleaner is configured so that a contact pressure of the elastic member to the body to be cleaned is constant in the predetermined direction.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 11 is a diagram illustrating an experimental result of a first evaluation experiment; and FIG. 12 is a diagram illustrating an experimental result of a second evaluation experiment.

DETAILED DESCRIPTION OF EMBODIMENTS

Figure 1:
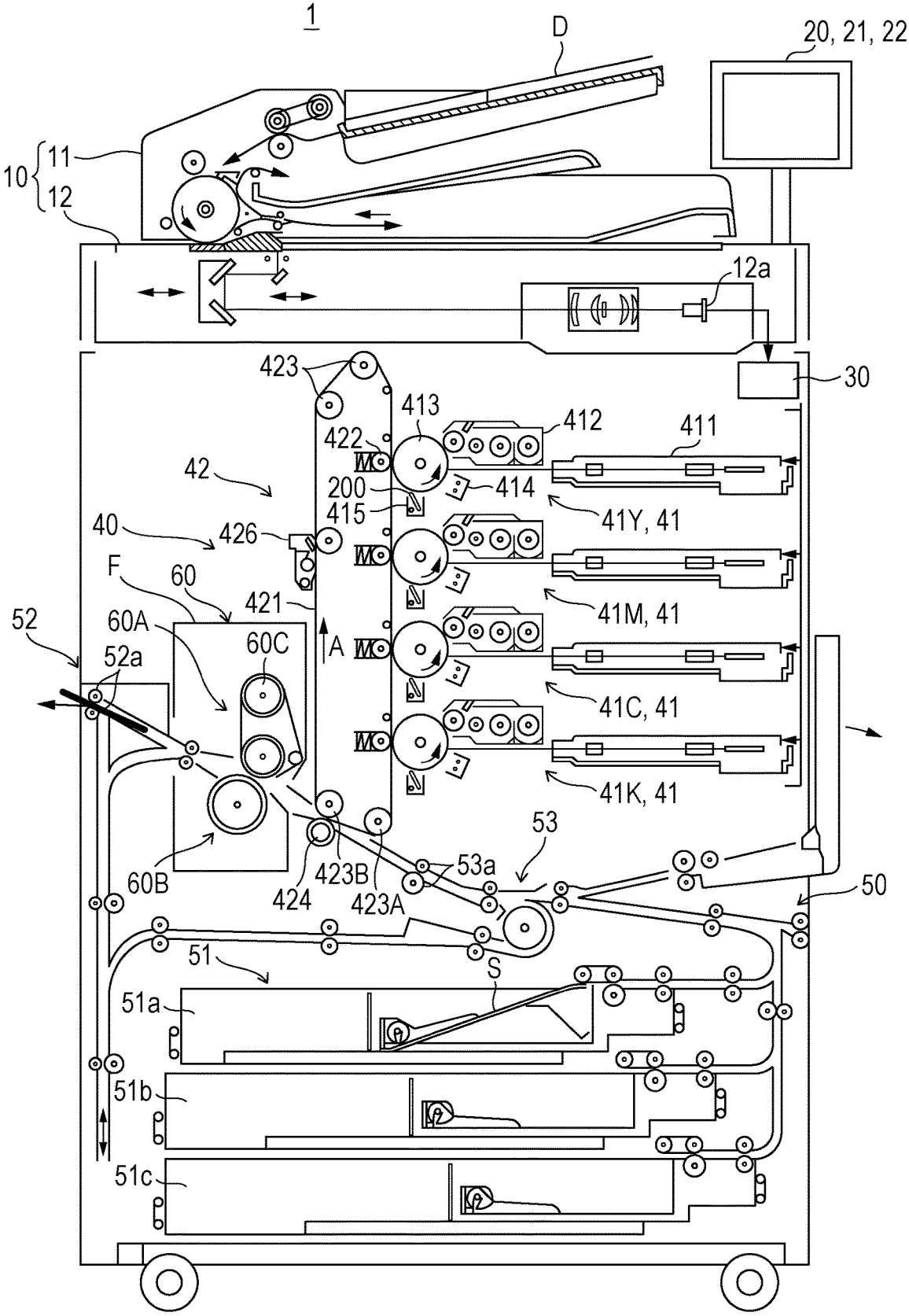
FIG. 1 is a diagram schematically illustrating an overall configuration of an image forming apparatus according to an embodiment of the present invention.
Figure 2:
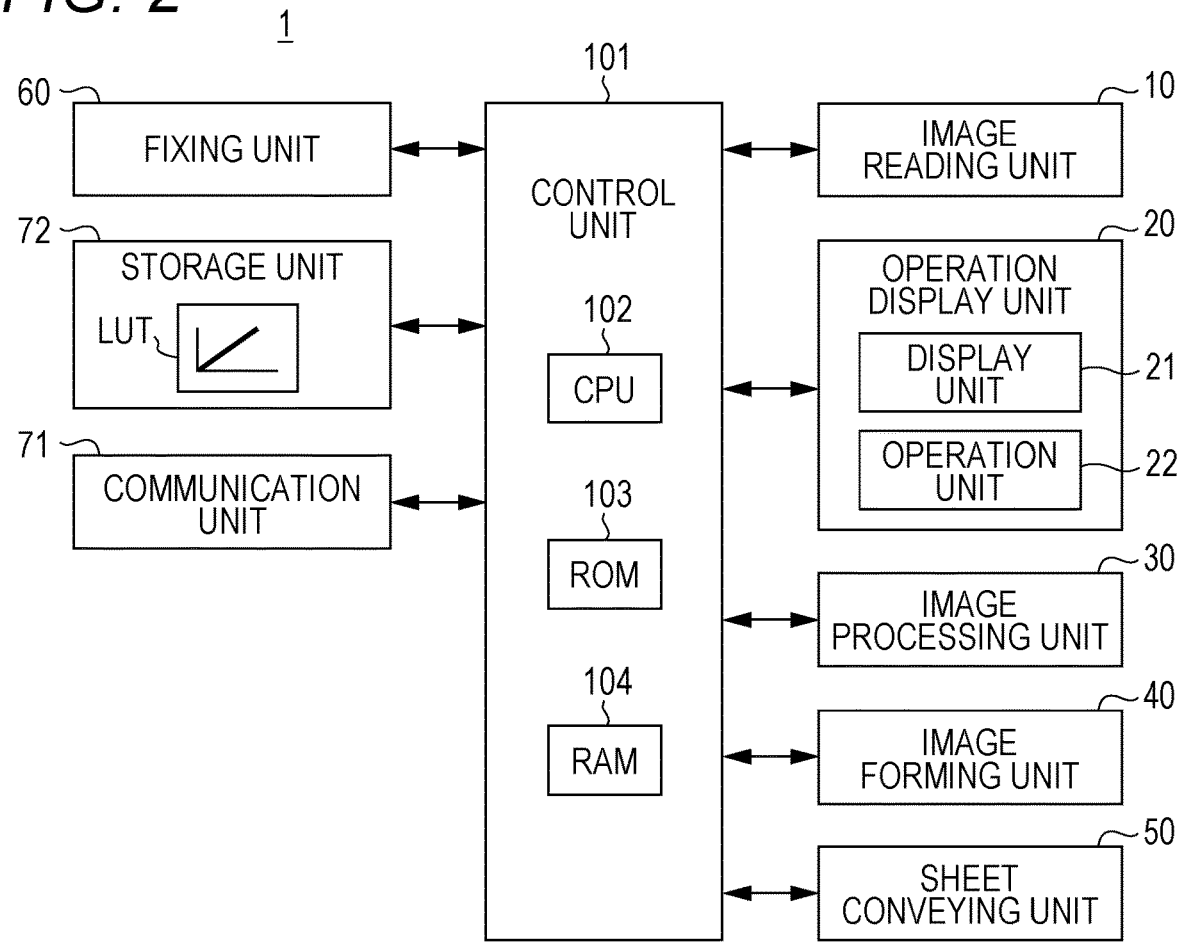
FIG. 2 is a diagram illustrating a main part of a control system of the image forming apparatus according to the present embodiment.

Hereinafter, one or more embodiments of the present invention will be described with reference to the drawings. However, the scope of the invention is not limited to the disclosed embodiments. FIG. 1 is a diagram schematically illustrating an overall configuration of an image forming apparatus 1 according to an embodiment of the present invention. FIG. 2 is a diagram illustrating a main part of a control system of the image forming apparatus 1 according to the present embodiment.

The image forming apparatus 1 illustrated in FIGS. 1 and 2 is an intermediate transfer-type color image forming apparatus using an electrophotographic process technology. That is, the image forming apparatus 1 primarily transfers individual color toner images of yellow (Y), magenta (M), cyan (C), and black (K) formed on a photoreceptor drum 413 to an intermediate transfer belt 421, superimposes the toner images of the four colors on the intermediate transfer belt 421, and then secondarily transfers the toner images to a sheet S (recording medium) to form an image.

In addition, the image forming apparatus 1 employs a tandem system in which the photoreceptor drums 413 corresponding to the four colors of YMCK are arranged in series in the traveling direction of the intermediate transfer belt 421, and individual color toner images are sequentially transferred to the intermediate transfer belt 421 in one procedure.

As illustrated in FIG. 2, the image forming apparatus 1 includes an image reading unit 10, an operation display unit 20, an image processing unit 30, an image forming unit 40, a sheet conveying unit 50, a fixing unit 60, and a control unit 101.

The control unit 101 includes a central processing unit (CPU) 102, a read only memory (ROM) 103, a random access memory (RAM) 104, and the like. The CPU 102 reads out a program corresponding to the processing content from the ROM 103, expands it in the RAM 104, and centrally controls the operation of each block of the image forming apparatus 1 in cooperation with the expanded program. At this time, various data stored in a storage unit 72 are referred to. The storage unit 72 includes, for example, a nonvolatile semiconductor memory (so-called flash memory) or a hard disk drive.

The control unit 101 transmits and receives various data to and from an external device (for example, a personal computer) connected to a communication network such as a local area network (LAN) or a wide area network (WAN) via a communication unit 71. For example, the control unit 101 receives image data transmitted from an external device, and forms an image on the sheet S on the basis of the image data (input image data). The communication unit 71 includes, for example, a communication control card such as a LAN card.

As illustrated in FIG. 1, the image reading unit 10 includes an automatic document feeder (ADF) 11, a document image scanner (scanner) 12, and the like.

The automatic document feeder 11 conveys a document D placed on a document tray by a conveying mechanism and sends the document D to the document image scanner 12. The automatic document feeder 11 can continuously read images (including both sides) of a large number of documents D placed on the document tray at once.

The document image scanner 12 optically scans a document conveyed onto a contact glass from the automatic document feeder 11 or a document placed on the contact glass, forms an image of reflected light from the document on a light receiving surface of a charge coupled device (CCD) sensor 12*a*, and reads a document image. The image reading unit 10 generates input image data on the basis of a reading result by the document image scanner 12. The input image data is subjected to predetermined image processing in the image processing unit 30.

As illustrated in FIG. 2, the operation display unit 20 includes, for example, a liquid crystal display (LCD) with a touch panel, and functions as a display unit 21 and an operation unit 22. The display unit 21 displays various operation screens, an image state, an operation status of each function, and the like according to a display control signal input from the control unit 101. The operation unit 22 includes various operation keys such as a ten-key and a start key, receives various input operations by a user, and outputs an operation signal to the control unit 101.

The image processing unit 30 includes a circuit or the like that performs digital image processing according to initial setting or user setting on the input image data. For example, the image processing unit 30 performs tone correction on the basis of tone correction data (tone correction table) under the control of the control unit 101. In addition to the tone correction, the image processing unit 30 performs various correction processing such as color correction and shading correction, compression processing, and the like on the input image data. The image forming unit 40 is controlled on the basis of the image data subjected to these processing.

As illustrated in FIG. 1, the image forming unit 40 includes image forming units 41Y, 41M, 41C, and 41K for forming images with color toners of a Y component, an M component, a C component, and a K component on the basis of input image data, an intermediate transfer unit 42, and the like.

The image forming units 41Y, 41M, 41C, and 41K for the Y component, the M component, the C component, and the K component have the same configuration. For convenience of illustration and description, common components are denoted by the same reference numerals, and Y, M, C, or K is added to the reference numerals to distinguish the components. In FIG. 1, only the components of the image forming unit 41Y for the Y component are denoted by reference numerals, and the reference numerals of the other components of the image forming units 41M, 41C, and 41K are omitted.

The image forming unit 41 includes an exposure device 411, a developing device 412, a photoreceptor drum 413, a charging device 414, a drum cleaning device 415, and the like.

The photoreceptor drum 413 is made of, for example, an organic photoreceptor in which a photosensitive layer made of a resin containing an organic photoconductor is formed on an outer peripheral surface of a drum-shaped metal substrate.

The control unit 101 rotates the photoreceptor drum 413 at a constant peripheral speed by controlling a drive current supplied to a drive motor (not illustrated) that rotates the photoreceptor drum 413.

The charging device 414 is, for example, a charging charger, and generates corona discharge to uniformly charge the surface of the photoreceptor drum 413 having photoconductivity to negative polarity.

The exposure device 411 includes, for example, a semiconductor laser, and irradiates the photoreceptor drum 413 with laser light corresponding to an image of each color component. As a result, an electrostatic latent image of each color component is formed on an image area irradiated with the laser light on the surface of the photoreceptor drum 413 due to a potential difference from the background area.

The developing device 412 is a two-component reversal type developing device, and forms a toner image by visualizing an electrostatic latent image by attaching a developer of each color component to the surface of the photoreceptor drum 413.

For example, a DC developing bias having the same polarity as the charging polarity of the charging device 414 or a developing bias in which a DC voltage having the same polarity as the charging polarity of the charging device 414 is superimposed on an AC voltage is applied to the developing device 412. As a result, reversal development for attaching toner to the electrostatic latent image formed by the exposure device 411 is performed.

The drum cleaning device 415 includes a cleaner 200 and the like for cleaning the photoreceptor drum 413, and removes toner remaining on the surface of the photoreceptor drum 413 without being transferred to the intermediate transfer belt 421. The drum cleaning device 415 corresponds to a "cleaning device" of the present invention. Details of the drum cleaning device 415 will be described later.

The intermediate transfer unit 42 includes an intermediate transfer belt 421, a primary transfer roller 422, a plurality of support rollers 423, a secondary transfer roller 424, a belt cleaning device 426, and the like.

The intermediate transfer unit 42 includes an endless belt, which is stretched around the plurality of support rollers 423 in a loop shape. At least one of the plurality of support rollers 423 is a driving roller, and the others are driven rollers. For example, a roller 423A disposed downstream of the primary transfer roller 422 for the K component in a belt traveling direction is preferably a driving roller. This makes it easy to maintain a traveling speed of the intermediate transfer belt 421 at a primary transfer nip constant. As the driving roller 423A rotates, the intermediate transfer belt 421 travels at a constant speed in the direction of the arrow A.

The primary transfer roller 422 is disposed on the inner peripheral surface side of the intermediate transfer belt 421 so as to face the photoreceptor drum 413 of each color component. The primary transfer roller 422 is pressed against the photoreceptor drum 413 with the intermediate transfer belt 421 interposed therebetween, thereby forming a primary transfer nip for transferring a toner image from the photoreceptor drum 413 to the intermediate transfer belt 421.

The secondary transfer roller 424 is disposed on the outer peripheral surface side of the intermediate transfer belt 421 so as to face a backup roller 423B disposed on the downstream side in the belt traveling direction of the driving roller 423A. The secondary transfer roller 424 is pressed against the backup roller 423B with the intermediate transfer belt 421 interposed therebetween, thereby forming a secondary transfer nip for transferring the toner image from the intermediate transfer belt 421 to the sheet S.

When the intermediate transfer belt 421 passes through the primary transfer nip, the toner images on the photoreceptor drums 413 are sequentially superimposed and primarily transferred onto the intermediate transfer belt 421. Specifically, a primary transfer bias is applied to the primary transfer roller 422, and a charge having a polarity opposite to that of the toner is applied to the back surface side of the intermediate transfer belt 421, that is, the side in contact with the primary transfer roller 422, whereby the toner image is electrostatically transferred to the intermediate transfer belt 421.

Thereafter, when the sheet S passes through the secondary transfer nip, the toner image on the intermediate transfer belt 421 is secondarily transferred to the sheet S. Specifically, a secondary transfer bias is applied to the backup roller 423B, and a charge having the same polarity as that of the toner is applied to the front surface side of the sheet S, that is, the side in contact with the intermediate transfer belt 421, whereby the toner image is electrostatically transferred to the sheet S, and the sheet S is conveyed toward the fixing unit 60.

The belt cleaning device 426 removes transfer residual toner remaining on the surface of the intermediate transfer belt 421 after the secondary transfer. Note that, in place of the secondary transfer roller 424, a so-called belt-type secondary transfer unit having a configuration in which a secondary transfer belt is stretched around a plurality of support rollers including a secondary transfer roller may be employed.

The fixing unit 60 includes an upper fixing unit 60A having a fixing surface side member disposed on a side of the fixing surface of the sheet S, that is, the surface on which the toner image is formed, a lower fixing unit 60B having a back surface side support member disposed on a side of the back surface of the sheet S, that is, the surface opposite to the fixing surface, a heating source 60C, and the like. The back surface side support member is pressed against the fixing surface side member to thereby form a fixing nip for nipping and conveying the sheet S.

The fixing unit 60 fixes the toner image on the sheet S by heating and pressurizing the sheet S on which the toner image has been secondarily transferred and conveyed at the fixing nip. The fixing unit 60 is disposed as a unit in a fixing device F.

The sheet conveying unit 50 includes a sheet feeding unit 51, a sheet discharging unit 52, a conveyance path unit 53, and the like. In three sheet feeding tray units 51*a* to 51*c* constituting the sheet feeding unit 51, the sheet S identified based on basis weight, size, and the like is stored for each preset type. The conveyance path unit 53 includes a plurality of conveyance rollers such as a registration roller pair 53*a*.

The sheets S stored in the sheet feeding tray units 51*a* to 51*c* are sent out one by one from the top, and are conveyed to the image forming unit 40 by the conveyance path unit 53. Then, in the image forming unit 40, the toner image on the intermediate transfer belt 421 is secondarily transferred collectively to one surface of the sheet S, and a fixing step is performed in the fixing unit 60. The sheet S on which the image is formed is discharged to the outside of the apparatus by the sheet discharging unit 52 including a sheet discharging roller 52*a*.

Figure 3:
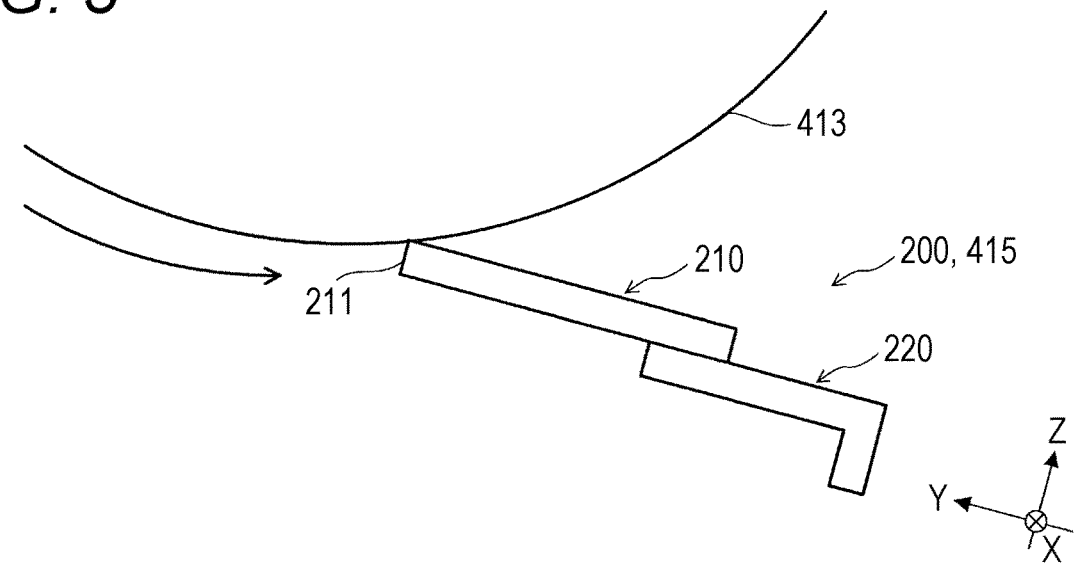
FIG. 3 is a side view of a cleaner.

Next, details of the drum cleaning device 415 will be described. FIG. 3 is a side view of the cleaner 200.

An orthogonal coordinate system (X, Y, Z) is used to describe the structure of the cleaner 200 of the present embodiment. Also in the drawings described later, they are indicated by a common orthogonal coordinate system (X, Y, Z). The X direction is a direction parallel to the width direction of the photoreceptor drum 413. The Y direction is a direction orthogonal to the width direction (X direction) of the photoreceptor drum 413 and the thickness direction of an elastic member 210, and is a direction in which the elastic member 210 to be described later extends from a support portion of a support member 220 to be described later. The Z direction is a thickness direction of the elastic member 210.

As illustrated in FIG. 3, as described above, the drum cleaning device 415 includes the cleaner 200 for cleaning the photoreceptor drum 413. The cleaner 200 includes the elastic member 210 and the support member 220.

The elastic member 210 is a plate-shaped member extending in the X direction and the Y direction, and is made of, for example, urethane rubber. The length of the elastic member 210 in the X direction is longer than the length of the elastic member 210 in the Y direction. The X direction corresponds to a "predetermined direction" of the present invention.

Note that the thickness (length in the Z direction) of the elastic member 210 is appropriately set according to the size of the image forming apparatus 1, for example, 0.5 to 2.0 mm. The length of the elastic member 210 in the Y direction is appropriately set according to the size of the image forming apparatus 1, such as 5 to 12 mm.

The elastic member 210 is disposed so that a plus side end part 211 in the Y direction abuts on the surface of the photoreceptor drum 413. As a result, the elastic member 210 abuts on the photoreceptor drum 413 to remove the toner remaining on the surface of the photoreceptor drum 413 without being transferred to the intermediate transfer belt 421.

Figure 4:
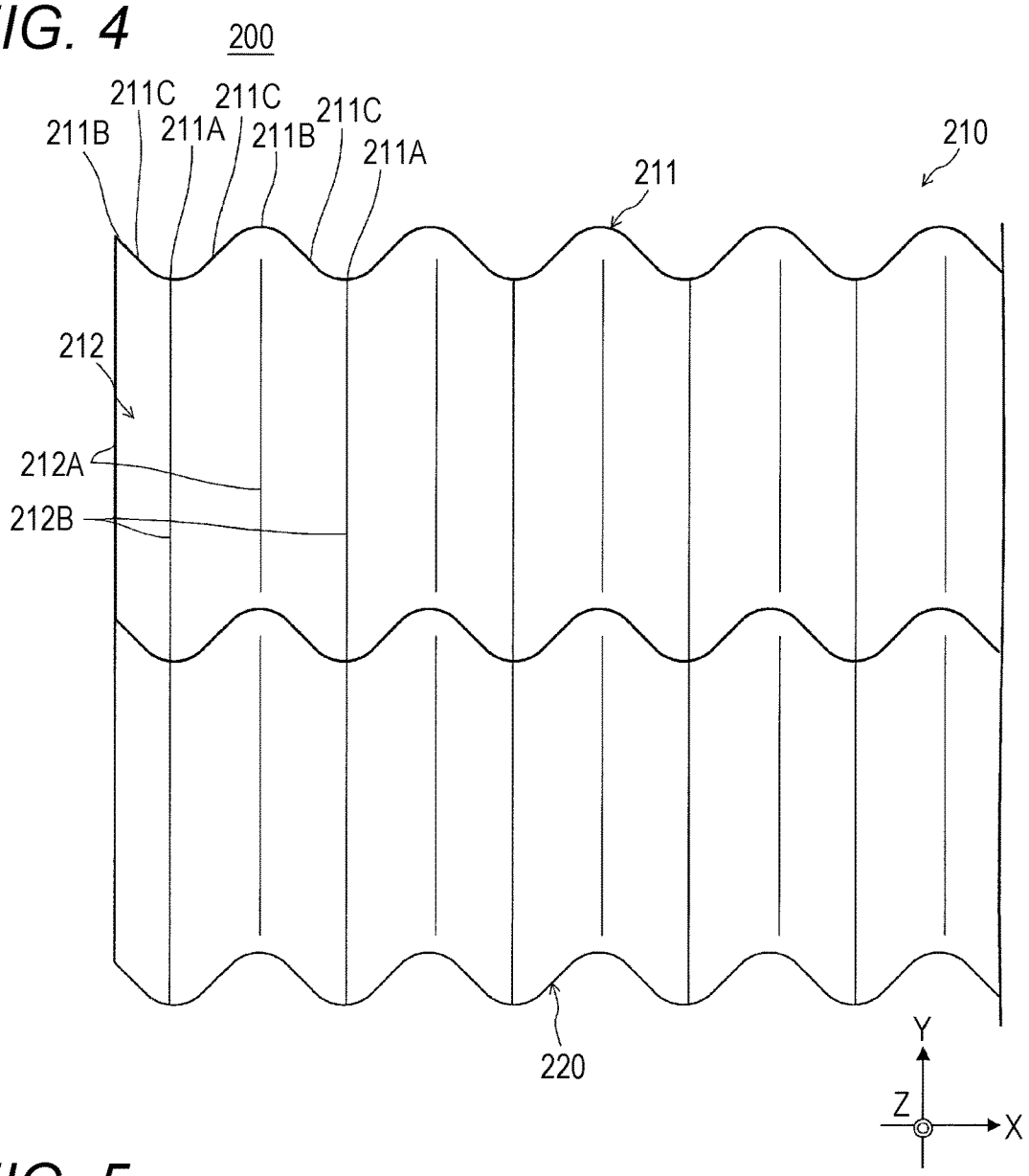
FIG. 4 is a view of the cleaner as viewed from a plus side in a Z direction.

As illustrated in FIG. 4, the plus side end part 211 of the elastic member 210 in the Y direction is formed in an uneven shape continuous in the X direction. That is, the contact portion of the elastic member 210 with respect to the photoreceptor drum 413 is formed in an uneven shape continuous in the X direction.

The uneven shape is a corrugated shape including a concave part 211A and a convex part 211B, and an inclined part 211C that is an inclined part 211C connecting the concave part 211A and the convex part 211B and is inclined with respect to the X direction. The uneven shape continuous in the X direction is, for example, a shape in which a corrugated shape including the concave part 211A and the convex part 211B is repeated in the X direction. More specifically, the uneven shape continuous in the X direction is a shape in which a shape in which two inclined parts 211C connecting two concave parts 211A sandwiching one convex part 211B and the one convex part 211B are arranged so as to be substantially symmetrical with respect to the one convex part 211B is repeated in the X direction.

The end part 211 in the Y direction of the elastic member 210 illustrated in FIG. 4 has a configuration in which an uneven shape is continuous in the arrangement order of the convex part 211B, the inclined part 211C, the concave part 211A, the inclined part 211C, and the convex part 211B from a minus side end part in the X direction.

The inclination angle of the inclined part 211C with respect to the X direction is, for example, in the range of 5 degrees to 45 degrees.

The elastic member 210 abuts on the photoreceptor drum 413 with a predetermined pressing force in order to scrape the transfer residual toner on the photoreceptor drum 413 after the transfer. Therefore, the elastic member 210 wears due to a frictional force generated between the elastic member 210 and the photoreceptor drum 413.

In the present embodiment, since the plus side end part 211 of the elastic member 210 in the Y direction has an uneven shape including the inclined part 211C, the frictional force generated by the contact between the elastic member 210 and the photoreceptor drum 413 can be applied to a portion related to the inclined part 211C.

In other words, the stress generated along the moving direction of the photoreceptor drum 413 parallel to the Y direction can be applied in a direction oblique to the Y direction (direction substantially orthogonal to the inclined part 211C) due to the presence of the inclined part 211C. As a result, stress vibration inside the elastic member 210 is reduced, so that the influence of wear of the elastic member 210 due to the frictional force can be reduced.

Figure 5:
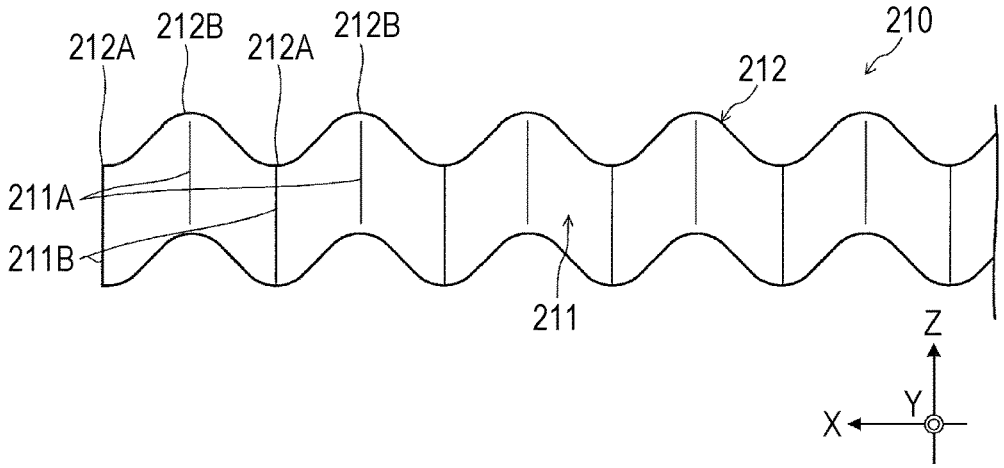
FIG. 5 is a view of an elastic member as viewed from a plus side in a Y direction.

As illustrated in FIGS. 4 and 5, an end surface 212 in the Z direction of the elastic member 210 (the surface facing the photoreceptor drum 413 side connected to the plus side end part 211 in the Y direction constituting the uneven shape) has an uneven shape continuous in the X direction. The uneven shape of the end surface 212 in the Z direction is a corrugated shape similarly to the shape of the end surface in the Y direction, but a concave portion 212A of the end surface 212 in the Z direction is located at a position corresponding to the convex part 211B of the end part 211 in the Y direction, and a convex portion 212B of the end surface 212 in the Z direction is located at a position corresponding to the concave part 211A of the end part 211 in the Y direction.

That is, the elastic member 210 has a configuration in which the first portion (convex portion 212B) corresponding to the concave part 211A at the end part 211 in the Y direction protrudes to the plus side in the Z direction from the second portion (concave portion 212A) corresponding to the convex part 211B at the end part 211 in the Y direction on the end surface 212 in the Z direction.

Figure 6A:
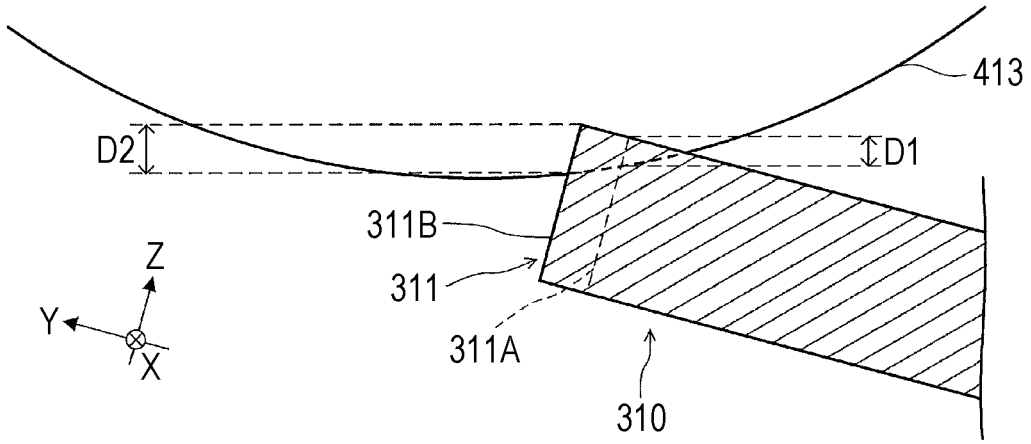
FIG. 6A is an enlarged cross-sectional view of a contact portion of the elastic member having a flat shape with a photoreceptor drum.

Meanwhile, as illustrated in FIG. 6A, in a case where the end surface in the Z direction of an elastic member 310 has a flat configuration, a deflection amount D1 caused by a concave part 311A of an end part 311 in the Y direction abutting on the photoreceptor drum 413 is different from a deflection amount D2 caused by a convex part 311B of the end part 311 in the Y direction abutting on the photoreceptor drum 413. Specifically, since the concave part 311A of the end part 311 in the Y direction is more concave than the convex part 311B with respect to the photoreceptor drum 413, the deflection amount D1 of the concave part 311A of the end part 311 in the Y direction is smaller than the deflection amount D2 of the convex part 311B in the Y direction.

Therefore, the contact pressure of the elastic member 310 differs between the position of the concave part 311A and the position of the convex part 311B, and unevenness of the contact pressure occurs in the X direction, which causes the toner to slip through between the elastic member 310 and the photoreceptor drum 413. In addition, if the uneven shape is made minute in order to reduce the difference between the deflection amount D1 of the concave part 311A and the deflection amount D2 of the convex part 311B, the influence of the frictional force generated by the contact between the elastic member 310 and the photoreceptor drum 413 becomes large, and there is a possibility that the elastic member 310 is easily worn or a large number of products not satisfying the accuracy requirement are generated, and the yield is deteriorated.

Figure 6B:
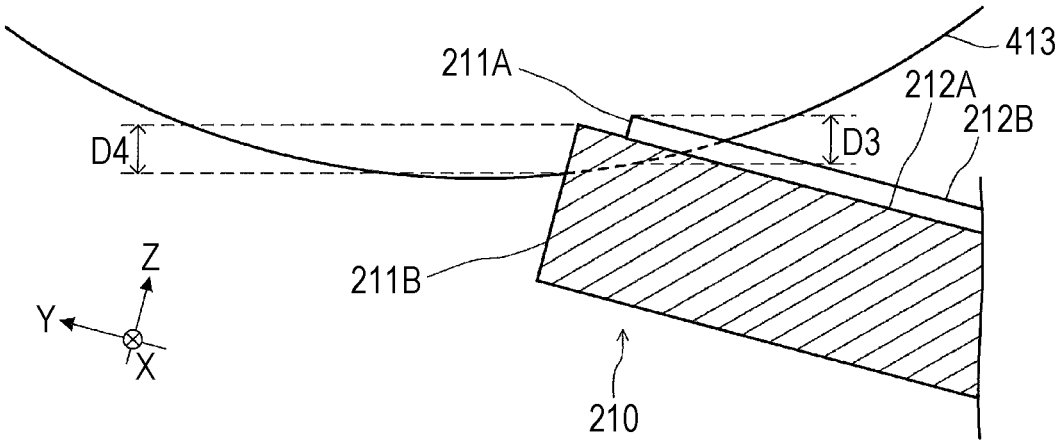
FIG. 6B is an enlarged cross-sectional view of a contact portion of the elastic member with the photoreceptor drum according to the present embodiment.

On the other hand, in the present embodiment, as illustrated in FIG. 6B, the elastic member 210 is configured so that the portion of the concave part 211A of the end part 211 in the Y direction protrudes to the plus side in the Z direction from the portion of the convex part 211B of the end part 211 in the Y direction, so that the portion (convex portion 212B) protruding to the plus side in the Z direction can bite into the photoreceptor drum 413.

Then, by adjusting the protruding amount of the convex portion 212B with respect to the concave portion 212A, the arrangement of the elastic member 210, and the like, it is possible to make a deflection amount D3 in the concave part 211A having the uneven shape at the end part 211 in the Y direction and a deflection amount D4 in the convex part 211B having the uneven shape at the end part 211 in the Y direction constant.

That is, the elastic member 210 is configured so that the deflection amount D3 and the deflection amount D4 are constant, whereby the cleaner 200 is configured so that the contact pressure of the elastic member 210 with respect to the photoreceptor drum 413 is constant in the X direction.

As a result, it is possible to absorb the difference in the contact pressure in the X direction caused by the uneven shape at the end part 211 in the Y direction, and eventually, it is possible to suppress the toner from slipping through between the elastic member 210 and the photoreceptor drum 413.

Since the deflection amount D3 related to the concave part 211A at the end part 211 in the Y direction and the deflection amount D4 related to the convex part 211B at the end part 211 in the Y direction can be made constant, the uneven shape at the end part 211 in the Y direction can be increased, and the occurrence of wear of the elastic member 210 can be further reduced.

In addition, the uneven shape of the end surface 212 in the Z direction of the elastic member 210 is configured by the concave portion 212A, the convex portion 212B, and the inclined portion connecting the concave portion 212A and the convex portion 212B, but it is preferable to form the uneven shape so that the deflection amount at each position in the X direction is constant. Specifically, it is desirable to form the uneven shape of the end surface 212 in the Z direction of the elastic member 210 so that a value obtained by dividing the deflection amount at each position in the X direction by the cube of the free length at each position in the X direction is constant at each position in the X direction.

The free length at each position in the X direction is a distance (length in the Y direction) from a distal end of the support portion of the support member 220 (distal end of the plus side end part in the Y direction of the support member 220) to a distal end of the contact portion of the elastic member 210 (distal end of the plus side end part 211 in the Y direction).

For example, the uneven shape of the end surface 212 in the Z direction is configured so that a first divided value obtained by dividing the deflection amount D3 of the concave part 211A having the uneven shape in the elastic member 210 due to the contact of the photoreceptor drum 413 by the cube of the free length of the concave part 211A is equal to a second divided value obtained by dividing the deflection amount D4 of the convex part 211B having the uneven shape in the elastic member 210 due to the contact of the photoreceptor drum 413 by the cube of the free length of the convex part 211B.

As a result, the contact pressure of the elastic member 210 with respect to the photoreceptor drum 413 can be made constant in the X direction.

Figure 7:
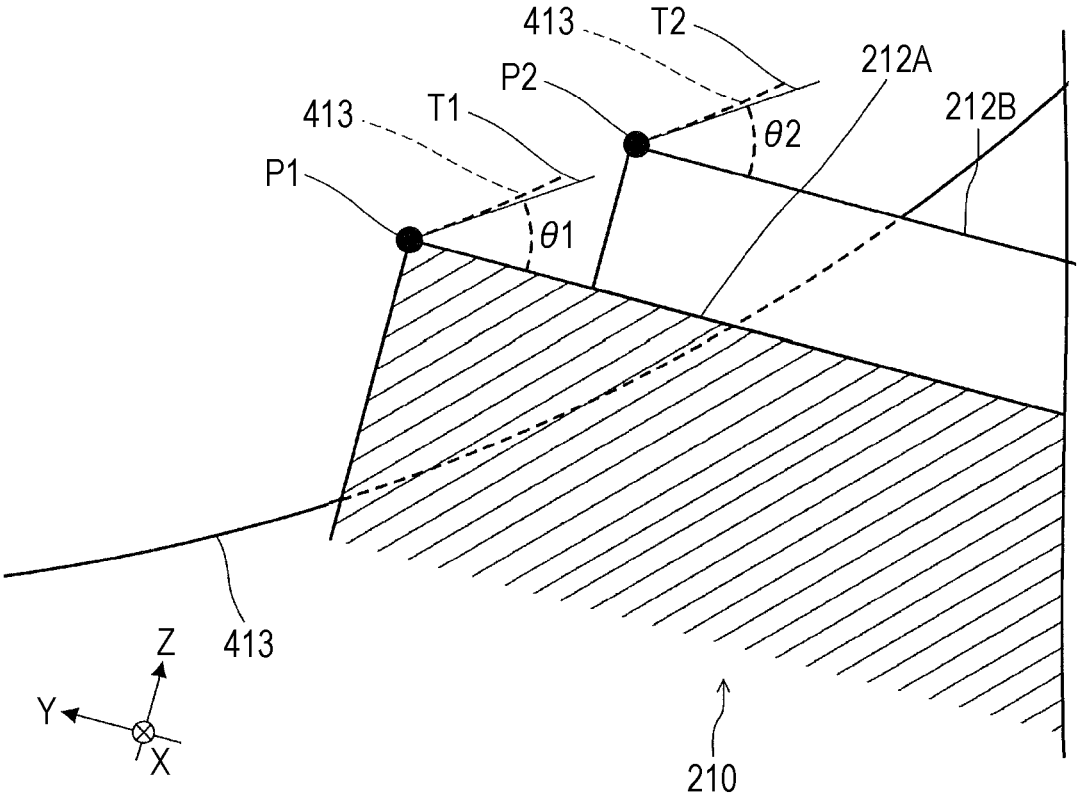
FIG. 7 is a view for explaining a contact angle of an elastic member.

Further, as illustrated in FIG. 7, the uneven shape of the end surface 212 in the Z direction of the elastic member 210 is configured so that an angle (hereinafter, the contact angle of the elastic member 210) formed between a tangent line of the photoreceptor drum 413 and the elastic member 210 at a contact point between the elastic member 210 and the photoreceptor drum 413 is constant in the X direction.

Specifically, the elastic member 210 is disposed so that a contact angle θ1 corresponding to the concave portion 212A is equal to a contact angle θ2 corresponding to the convex portion 212B.

The contact angle θ1 is an angle formed between a tangent line T1 of the photoreceptor drum 413 at a contact point P1 with the photoreceptor drum 413 corresponding to the concave portion 212A on the end surface 212 in the Z direction of the elastic member 210 and a portion corresponding to the concave portion 212A on the end surface 212 in the Z direction.

The contact angle θ2 is an angle formed between a tangent line T2 of the photoreceptor drum 413 at a contact point P2 with the photoreceptor drum 413 corresponding to the convex portion 212B on the end surface 212 in the Z direction of the elastic member 210 and a portion corresponding to the convex portion 212B on the end surface 212 in the Z direction.

Note that the photoreceptor drum 413 indicated by a broken line at the contact points P1 and P2 indicates the position of the photoreceptor drum 413 when the concave portion 212A and the convex portion 212B bite into the photoreceptor drum 413.

For example, in the case of a configuration in which the end surface in the Z direction of the elastic member is flat, since the deflection amount is different between the concave part and the convex part at the end part in the Y direction of the elastic member, the contact angle of the elastic member is different. Therefore, since the scraping force in the elastic member is different in the X direction, the toner slipping-through is likely to occur in a portion where the scraping force becomes weak, and the wear of the elastic member is likely to occur in a portion where the scraping force becomes strong.

On the other hand, in the present embodiment, since the contact angle of the elastic member 210 is configured to be constant in the X direction, it is possible to achieve both suppression of toner slipping-through and suppression of wear of the elastic member 210.

Figure 8:
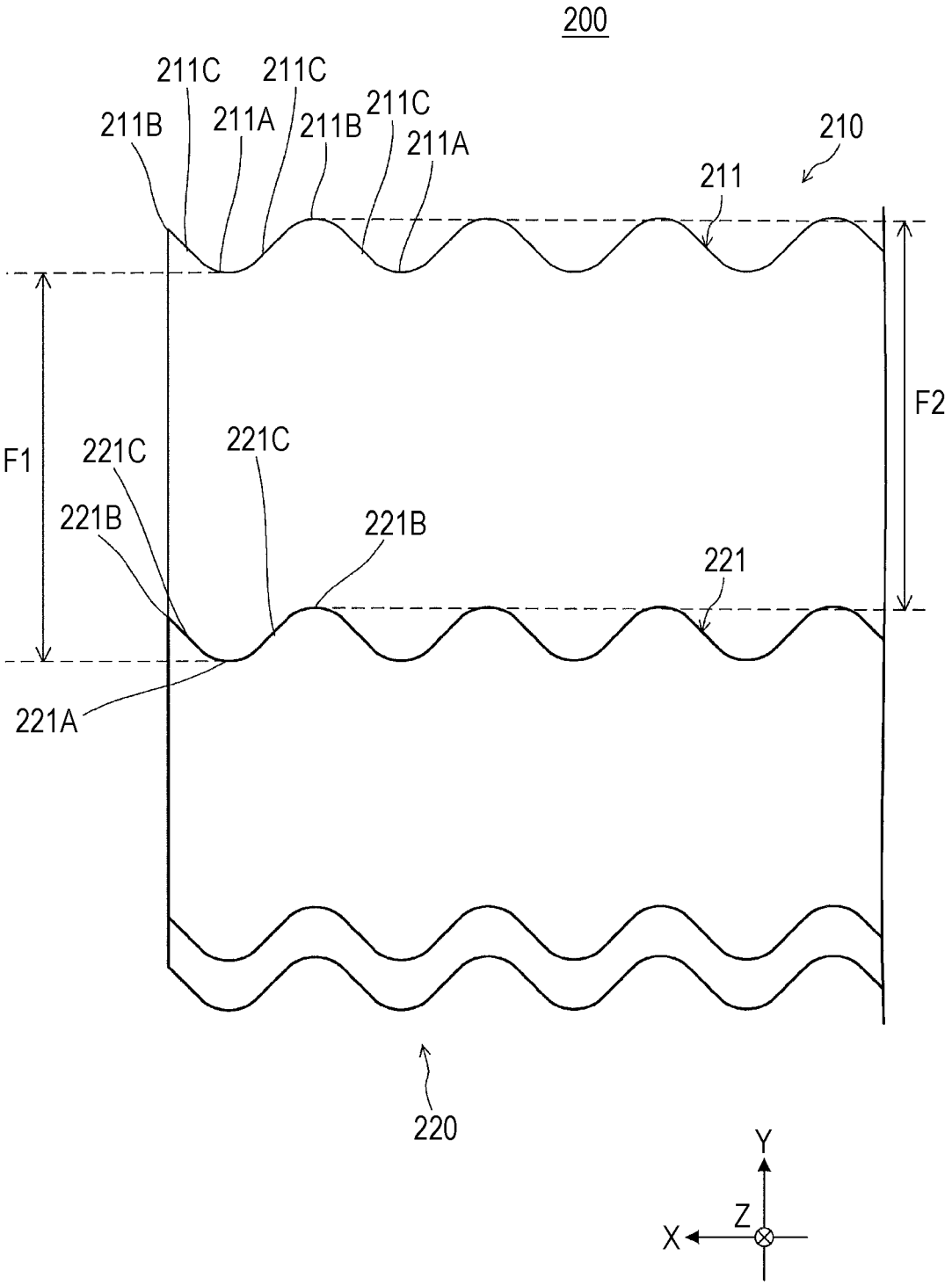
FIG. 8 is a view of the cleaner as viewed from a minus side in the Z direction.

As illustrated in FIG. 8, the support member 220 is a sheet metal that supports the elastic member 210, and is fixed to a housing or the like constituting the drum cleaning device 415. The support member 220 is formed by bending a steel plate such as SECC into an L shape (see also FIG. 3).

The support member 220 supports the minus side end part of the elastic member 210 in the Y direction from the minus side of the elastic member 210 in the Z direction at the plus side end part in the Y direction. The support member 220 and the elastic member 210 are bonded to each other by an adhesive (for example, a thermoplastic hot-melt adhesive), a double-sided tape, or the like.

The plus side end part 221 in the Y direction of the support member 220 has an uneven shape continuous in the X direction similarly to the plus side end part 211 in the Y direction of the elastic member 210. That is, the support portion of the elastic member 210 in the support member 220 is formed in an uneven shape continuous in the X direction, and is formed in substantially the same shape as the plus side end part 211 of the elastic member 210 in the Y direction.

Specifically, the uneven shape of the support member 220 is a shape in which a corrugated shape including a concave part 221A and a convex part 221B is repeated in the X direction, and includes the concave part 221A, the convex part 221B, and an inclined part 221C connecting the concave part 221A and the convex part 221B similarly to the plus side end part 211 of the elastic member 210 in the Y direction.

More specifically, the position in the X direction of the concave part 221A having the uneven shape in the support member 220 is the same as the position in the X direction of the concave part 211A of the plus side end part 211 in the Y direction in the elastic member 210. Further, the position in the X direction of the convex part 221B having the uneven shape in the support member 220 is the same as the position in the X direction of the convex part 211B of the plus side end part 211 in the Y direction in the elastic member 210.

Further, the position in the X direction of the inclined part 221C having the uneven shape in the support member 220 is the same as the position in the X direction of the inclined part 211C of the plus side end part 211 in the Y direction in the elastic member 210. Further, the inclined part 221C of the support member 220 is substantially parallel to the inclined part 211C of the elastic member 210 having the same position in the X direction.

As a result, the support member 220 supports the elastic member 210 so that the free length of the elastic member 210 is constant in the X direction.

For example, a free length F1 corresponding to the concave part 211A of the elastic member 210 and the concave part 221A of the support member 220 is equal to a free length F2 corresponding to the convex part 211B of the elastic member 210 and the convex part 221B of the support member 220.

As described above, since the free length of the elastic member 210 is constant at each position in the X direction, the rigidity of the elastic member 210 when the elastic member 210 slides with respect to the photoreceptor drum 413 can be made uniform in the X direction.

As a result, the contact pressure of the elastic member 210 against the photoreceptor drum 413 can be made constant in the X direction. That is, in the present exemplary embodiment, the cleaner 200 is configured so that the contact pressure of the elastic member 210 with respect to the photoreceptor drum 413 is constant in the X direction. As a result, it is possible to suppress the occurrence of unevenness in the entire X direction in the contact pressure of the elastic member 210, and eventually, it is possible to suppress the occurrence of cleaning failure.

Further, the support member 220 is configured so that the end surface in the Z direction has an uneven shape in accordance with the uneven shape of the end surface 212 in the Z direction of the elastic member 210, but the end surface in the Z direction may not have an uneven shape.

The cleaner 200 may be configured to be movable in the X direction. In the present embodiment, since the plus side end part 211 of the elastic member 210 in the Y direction has an uneven shape, wear of the elastic member 210 is easily reduced. However, since the inclination angle is small around the inflection point in the inclined part 211C connecting the convex part 211B and the concave part 211A in the uneven shape, the effect of reducing the wear of the elastic member 210 is reduced.

Therefore, the amount of toner slipping-through around the inflection point increases, and the surface of the photoreceptor drum 413 is damaged when the toner slips through. In particular, since the toner easily accumulates in the concave part 211A, the amount of slipping-through around the inflection point related to the concave part 211A tends to increase.

Therefore, under the control of the control unit 101 or the like, the cleaner 200 is moved in the X direction so as not to stop the portion around the inflection point at a certain position. As a result, the scratches on the surface of the photoreceptor drum 413 generated when the toner slips through can be dispersed in the X direction, so that the degree of influence by the scratches can be reduced.

The cleaner 200 may be configured so that a moving distance of the cleaner 200 is shorter than a distance between two adjacent convex parts 211B in the uneven shape of the elastic member 210.

In this way, when the cleaner 200 is moved, for example, the predetermined concave part 211A can be suppressed from moving to the position corresponding to the concave part 211A located adjacent to the predetermined concave part 211A. That is, it is possible to suppress movement from a position where toner slipping-through is likely to occur to another position where toner slipping-through is likely to occur.

Note that, in the present embodiment, the fact that the contact pressure becomes constant in the X direction means that, for example, a value obtained by dividing a difference between a maximum value of the contact pressure and a minimum value of the contact pressure by an average contact pressure in the X direction is 10% or less. In addition, the value is preferably as small as possible, for example, 6% or less.

Figure 9:
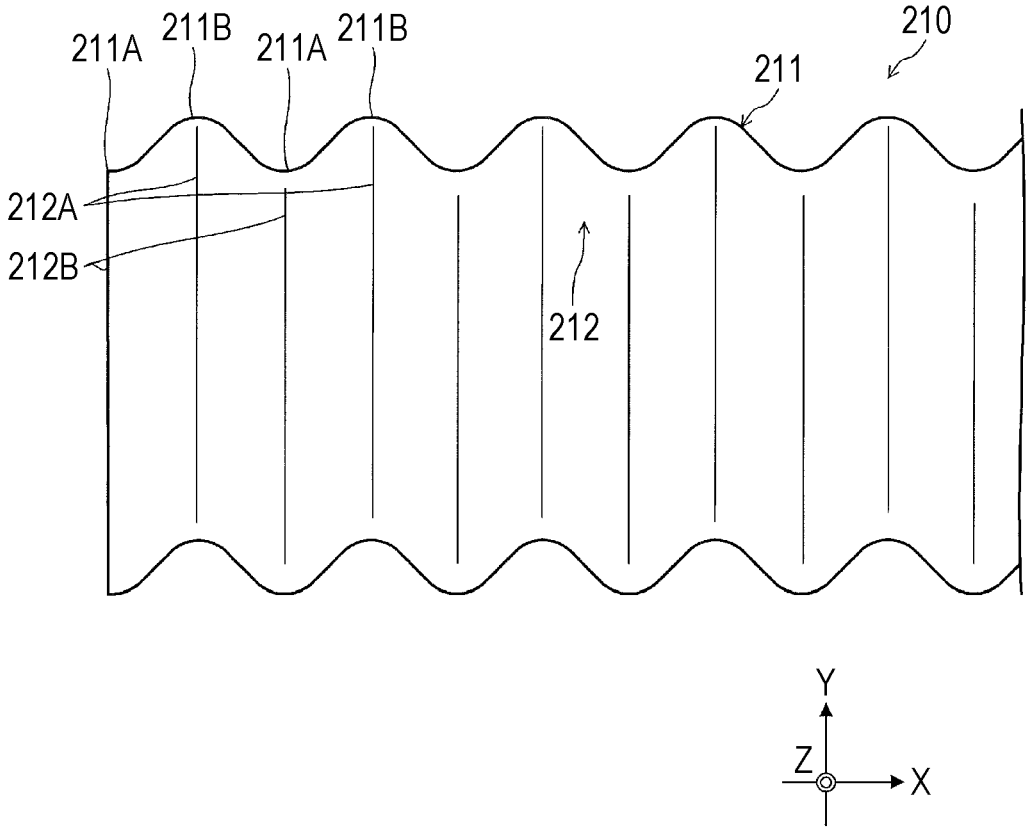
FIG. 9 is a view illustrating an elastic member in which an end part in an X direction is a concave part.

In the above embodiment, the end part in the X direction related to the plus side end part 211 in the Y direction in the uneven shape of the elastic member 210 is the convex part 211B, but the present invention is not limited thereto, and the end part in the X direction may be the concave part 211A as illustrated in FIG. 9.

Since the end part in the X direction of the elastic member 210 is not restricted from the outside of the elastic member 210, the end part is in a state of being easily deformed due to the rotation of the photoreceptor drum 413.

When the end part in the X direction of the elastic member 210 is the convex part 211B, a force attracted from the photoreceptor drum 413 is received, that is, a force toward the outside of the end part in the X direction (a force along a direction substantially orthogonal to the inclined part 211C) acts on the portion of the inclined part 211C in the convex part 211B, so that the elastic member 210 may be curled.

On the other hand, when the end part in the X direction of the elastic member 210 is the concave part 211A, a force toward the inside of the end part in the X direction acts on the portion of the inclined part 211C in the concave part 211A, so that the curling of the elastic member 210 is less likely to occur.

That is, by forming the end part in the X direction related to the end part 211 in the Y direction in the uneven shape of the elastic member 210 as the concave part 211A, it is possible to suppress the occurrence of curling of the elastic member 210.

Figure 10:
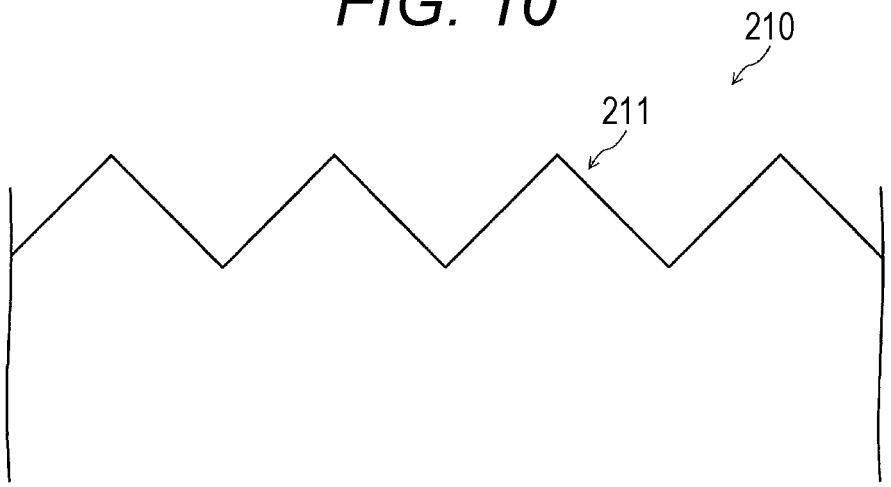
FIG. 10 is a view illustrating a configuration in which an uneven shape is a triangular shape.

In the above embodiment, the corrugated shape is exemplified as the uneven shape, but the present invention is not limited thereto, and may be a triangular shape (see FIG. 10) or a saw blade shape.

In the above embodiment, as the uneven shape, the shape in which the line connecting the concave part and the convex part includes the inclined part inclined with respect to the X direction is exemplified, but the present invention is not limited thereto. For example, the uneven shape may be a rectangular wave shape. However, from the viewpoint of suppressing stress vibration, the uneven shape is preferably a shape including the inclined part.

In addition, in the above-described embodiment, as the configuration in which the contact pressure in the X direction in the cleaner is constant, the configuration in which the end surface in the Z direction of the elastic member has an uneven shape and the plus side end part in the Y direction of the support member has an uneven shape has been exemplified, but the present invention is not limited thereto. For example, as the configuration in which the contact pressure in the X direction in the cleaner is constant, at least one of the configuration in which the end surface in the Z direction of the elastic member has an uneven shape and the configuration in which the plus side end part in the Y direction of the support member has an uneven shape may be adopted.

Further, in the above embodiment, the drum cleaning device in which the photoreceptor drum is the body to be cleaned is exemplified as the cleaning device, but the present invention is not limited thereto, and a device in which other than the photoreceptor drum is the body to be cleaned, such as a belt cleaning device, may be used as the cleaning device.

In addition, any of the above-described embodiments is merely an example of embodying the present invention, and the technical scope of the present invention should not be interpreted in a limited manner by these. That is, the present invention can be implemented in various forms without departing from the scope or main features of the present invention.

Next, an evaluation experiment of the image forming apparatus 1 according to the present embodiment will be described. First, using the image forming apparatus 1 illustrated in FIG. 1, an experiment (first evaluation experiment) for evaluating the occurrence of cleaning failure was performed. As evaluation conditions, the temperature condition was 23° C., the humidity condition was 50% RH, the sheet size was A3 size, and the image formed on the sheet was a longitudinal band solid image with a width of 20 mm located at the center in the longitudinal direction of the sheet.

FIG. 11 shows experimental results of the first evaluation experiment. "Initial" in FIG. 11 is an evaluation result of cleaning failure after an image was formed on 1000 sheets by the new cleaner 200. "Durability" in FIG. 11 is an evaluation result of cleaning failure after an image was formed on 1000k sheets by the new cleaner 200. The wear width in FIG. 11 indicates the wear width of the elastic member after the image was formed on 1000k sheets.

"x" in the evaluation result of the cleaning failure indicates that the toner having slipped through the elastic member adhered to a range exceeding a width of 20 mm in another member (for example, a brush for applying a lubricant), and the degree of the cleaning failure is relatively large. "Δ" in the evaluation result of the cleaning failure indicates that the toner having slipped through the elastic member adhered to a range of a width of 20 mm or less in another member, and the degree of the cleaning failure is relatively small, so that there is no problem in practical use. "o" in the evaluation result of the cleaning failure indicates that the toner did not slip through the elastic member and the toner did not adhere to another member. "⊙" in the evaluation result of the cleaning failure indicates that the toner did not slip through the elastic member and the toner did not adhere to the elastic member and other members.

In a first example, the inclination angle of the inclined part with respect to the X direction in the configuration illustrated in FIG. 4 is 3 degrees. In a second example, the inclination angle of the inclined part with respect to the X direction in the configuration illustrated in FIG. 4 is 5 degrees. In a third example, the inclination angle of the inclined part with respect to the X direction in the configuration illustrated in FIG. 4 is 20 degrees. In a fourth example, the inclination angle of the inclined part with respect to the X direction in the configuration illustrated in FIG. 4 is 45 degrees. In a fifth example, the inclination angle of the inclined part with respect to the X direction in the configuration illustrated in FIG. 4 is 50 degrees. In a sixth example, the inclination angle of the inclined part with respect to the X direction in the configuration illustrated in FIG. 4 is 20 degrees, and the cleaner is configured to be movable.

In a first comparative example, the end part of the elastic member in the Y direction has a flat shape. In a second comparative example, the end part in the Y direction of the elastic member has an uneven shape, the end surface in the Z direction has a flat shape, and the end part in the Y direction has a flat shape.

According to the experimental results in FIG. 11, in the first comparative example, the cleaning failure did not occur in the "initial", but the degree of the cleaning failure was relatively large in the "durability". In the first comparative example, the relatively large wear width is considered to be a factor of the cleaning failure in the "durability".

In the second comparative example, it was confirmed that a relatively small degree of cleaning failure occurred in the "initial", and it was confirmed that a relatively large degree of cleaning failure occurred in the "durability". In the cleaning failure in the "initial", the occurrence of unevenness in the X direction at the contact pressure and the contact angle is considered to be a cause of the cleaning failure. Further, in the cleaning failure in the "durability", the wear width was reduced in the inclined part due to the effect of suppressing the stress vibration, but unevenness occurred in the X direction in the contact pressure and the contact angle in the concave part and the convex part, so that the toner slipping-through increased, and the wear width increased is considered to be a cause of the cleaning failure.

In the first to sixth examples, no cleaning failure occurred in the "initial". This is considered to be because the contact pressure and the contact angle of the elastic member become constant in the X direction.

Regarding "durability", in the first example and the fifth example, it was confirmed that a relatively small degree of cleaning failure occurred. However, since the wear width was smaller than those of the first comparative example and the second comparative example, a slight cleaning failure occurred as compared with the cleaning failures of the first comparative example and the second comparative example. That is, it was confirmed that the stress vibration inside the elastic member was reduced and the wear was reduced by the inclined part having the uneven shape of the elastic member.

In the second to fourth examples and the sixth example, it was confirmed that no cleaning failure occurred in the "durability". That is, as compared with the first example and the fifth example, it was confirmed that the range in which the inclination angle of the inclined part is 5 to 45 degrees is preferable as the range of the inclination angle.

In the sixth example, it was confirmed that no cleaning failure occurred in the "durability", and it was confirmed that the effect of suppressing the cleaning failure was improved as compared with the third example in which the inclination angles of the inclined parts were the same. This is considered to be because scratches on the photoreceptor drum were dispersed in the X direction by moving the cleaner, and the degree of influence by the scratches was reduced as a whole.

Next, in the fourth example described above, in the seventh example in which the end part having the uneven shape in the X direction was a convex part and the eighth example in which the end part having the uneven shape in the X direction was a concave part, an experiment (second evaluation experiment) was conducted to evaluate whether or not the end part was curled.

As the evaluation conditions, the temperature condition was set to 30° C., the humidity condition was set to 80% RH, the sheet size was set to A3 size, the image formed on the sheet had a coverage of 0%, the number of printed sheets was set to 1500, and the presence or absence of occurrence of curling and the number of occurrence of curling were checked. FIG. 12 shows experimental results of the second evaluation experiment.

As shown in FIG. 12, in the seventh example, it was confirmed that 221 sheets out of 1500 sheets were curled. On the other hand, in the eighth example, it was confirmed that no curling occurred. That is, it was confirmed that the occurrence of curling can be suppressed by forming the end part in the X direction of the uneven shape as the concave part.

Although embodiments of the present invention have been described and illustrated in detail, the disclosed embodiments are made for purposes of illustration and example only and not limitation. The scope of the present invention should be interpreted by terms of the appended claims

What is claimed is:

1. A cleaning device comprising a cleaner that cleans a body to be cleaned, wherein the cleaner includes:

an elastic member in which a contact portion in contact with the body to be cleaned is formed in an uneven shape continuous in a predetermined direction; and a support member that supports the elastic member, and the cleaner is configured so that a contact pressure of the elastic member to the body to be cleaned is constant in the predetermined direction.

2. The cleaning device according to claim 1, wherein a support portion of the elastic member in the support member is formed in an uneven shape continuous in the predetermined direction.

3. The cleaning device according to claim 2, wherein the support member supports the elastic member so that a free length of the elastic member, which is a distance from a distal end of the support portion to a distal end of the contact portion, is constant in the predetermined direction.

4. The cleaning device according to claim 1, wherein the elastic member is configured so that a deflection amount due to contact with the body to be cleaned in a concave part having the uneven shape and a deflection amount due to contact with the body to be cleaned in a convex part having the uneven shape are constant.

5. The cleaning device according to claim 4, wherein in the elastic member, a first portion corresponding to the concave part protrudes more than a second portion corresponding to the convex part on a surface facing a side of the body to be cleaned connected to an end part forming the uneven shape.

6. The cleaning device according to claim 5, wherein a first divided value obtained by dividing a deflection amount due to contact with the body to be cleaned in the concave part by a cube of a distance from a distal end of a support portion of the elastic member in the support member to a distal end of the contact portion in the concave part is equal to a second divided value obtained by dividing a deflection amount due to contact with the body to be cleaned in the convex part by a cube of a distance from a distal end of a support portion of the elastic member in the support member to a distal end of the contact portion in the convex part.

7. The cleaning device according to claim 4, wherein an angle formed between a tangent line of the body to be cleaned and the elastic member at a contact point between the elastic member and the body to be cleaned is constant in the predetermined direction.

8. The cleaning device according to claim 1, wherein the uneven shape includes a concave part, a convex part, and an inclined part that is an inclined part connecting the concave part and the convex part and is inclined with respect to the predetermined direction.

9. The cleaning device according to claim 8, wherein the uneven shape is a corrugated shape or a triangular shape.

10. The cleaning device according to claim 8, wherein an inclination angle of the inclined part with respect to the predetermined direction includes a range of 5 degrees to 45 degrees.

11. The cleaning device according to claim 1, wherein the cleaner is movable in the predetermined direction.

12. The cleaning device according to claim 11, wherein a moving distance of the cleaner is smaller than a distance between two adjacent convex parts in the uneven shape of the elastic member.

13. The cleaning device according to claim 1, wherein an end part in the predetermined direction of the uneven shape of the elastic member is a concave part.

14. An image forming apparatus comprising the body to be cleaned and the cleaning device according to claim 1.

* * * * *